US009533860B2

(12) United States Patent
Kalliomäki

(10) Patent No.: US 9,533,860 B2
(45) Date of Patent: Jan. 3, 2017

(54) ELEVATOR ARRANGEMENT AND A METHOD

(71) Applicant: KONE Corporation, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 326 days.

(21) Appl. No.: 14/031,910

(22) Filed: Sep. 19, 2013

(65) Prior Publication Data

US 2014/0075729 A1 Mar. 20, 2014

(30) Foreign Application Priority Data

Sep. 20, 2012 (EP) ..... 12185207

(51) Int. Cl.
*B66B 11/00* (2006.01)
*B66B 19/00* (2006.01)
*B66B 19/02* (2006.01)

(52) U.S. Cl.
CPC ..... *B66B 11/0065* (2013.01); *B66B 19/007* (2013.01); *B66B 19/02* (2013.01); *Y10T 29/49716* (2015.01)

(58) Field of Classification Search
CPC ..... B66B 11/0065; B66B 19/007; B66B 19/02
USPC ..... 187/264
See application file for complete search history.

(56) References Cited

U.S. PATENT DOCUMENTS 3,174,585 A * 3/1965 Tofanelli ..... B66B 11/009 187/264
3,519,101 A * 7/1970 Sieffert ..... B66B 9/187 187/256
3,720,291 A * 3/1973 Ivanov ..... B66B 19/02 187/266
5,117,945 A * 6/1992 Honda ..... B66B 7/068 187/264
5,513,724 A * 5/1996 De Jong ..... B66B 5/284 187/264
2002/0000348 A1 1/2002 Faletto
(Continued)

FOREIGN PATENT DOCUMENTS

CN 1324322 A 11/2001
DE 10-2010-032004 A1 1/2012
(Continued)

*Primary Examiner* — Michael Riegelman
(74) *Attorney, Agent, or Firm* — Birch, Stewart, Kolasch & Birch, LLP

(57) ABSTRACT

An elevator arrangement includes first and second movable elevator units, the first unit being an elevator car and the second unit being a counterweight, and a roping system including a first roping portion suspending the first and second elevator units, and being locked at least to the second elevator unit, a second roping portion being suspended by the first elevator unit and the second elevator unit, and being locked at least to the second elevator unit. The first and the second roping portions are successive portions of a roping passing unbroken via a locking arrangement provided at the second elevator unit, the locking arrangement locking the roping to the second elevator unit between the first and the second portions. In a method in constructing an elevator, the locking arrangement is unlocked and thereafter the roping is repositioned with respect to the locking arrangement and thereafter the locking arrangement is relocked.

20 Claims, 3 Drawing Sheets

(56) References Cited

U.S. PATENT DOCUMENTS

| | | | | |
|---|---|---|---|---|
| 2007/0170014 | A1* | 7/2007 | Woronoff | B66B 5/16 187/414 |
| 2007/0181381 | A1* | 8/2007 | Jungbauer | B66B 9/187 187/401 |
| 2009/0127033 | A1* | 5/2009 | Korkeakangas | B66B 19/02 187/414 |
| 2010/0163347 | A1* | 7/2010 | Van Der Meijden | B66B 19/00 187/254 |
| 2011/0017552 | A1* | 1/2011 | Lindberg | B66B 9/00 187/257 |
| 2012/0193170 | A1* | 8/2012 | Jacobs | B66B 11/0095 187/249 |
| 2012/0255150 | A1 | 10/2012 | Alasentie | |
| 2012/0291395 | A1* | 11/2012 | Plathin | B66B 19/02 52/741.1 |
| 2013/0248299 | A1 | 9/2013 | Perälä et al. | |
| 2015/0034425 | A1* | 2/2015 | Ratia | B66B 7/06 187/249 |

FOREIGN PATENT DOCUMENTS

| | | | | |
|---|---|---|---|---|
| FI | WO 2011076998 | A1 * | 6/2011 | B66B 19/02 |
| JP | 09-156855 | A | 6/1997 | |
| WO | WO 01/64572 | A1 | 9/2001 | |
| WO | WO 2012/072860 | A1 | 6/2012 | |

* cited by examiner

ELEVATOR ARRANGEMENT AND A METHOD

FIELD OF THE INVENTION

The object of the invention is an elevator arrangement and a method in constructing an elevator. The elevator is particularly meant for transporting passengers and/or goods.

BACKGROUND OF THE INVENTION

During initial construction of an elevator or in any later elevator modification a situation may arise where repositioning of elevator components that have been installed earlier is beneficial or even necessary. A need to reposition arises for instance in construction-time elevators, particularly in connection with a process for extending the service zone to reach higher in the elevator hoistway. In this type of elevator arrangements, which are also known as jump-lifts, the bottom part of an elevator hoistway is put to use already before the building has been completed. The top part of the elevator hoistway can be under construction at the same time as an elevator car moving in the bottom part of the elevator hoistway already serves people on the lower floors of the building. Generally in jump-lifts the elevator car moving in the lower parts of the elevator hoistway is supported by a movable supporting structure positioned above the car in the hoistway. The installation work in parts of the elevator hoistway above this support structure is performed from a working platform movable in the elevator hoistway above the support structure. The installation work may comprise, among other things, the installation of guide rails and electrification in the elevator hoistway. When the elevator hoistway under construction above the supporting structure has reached a sufficient stage of completion, the completed part of the elevator hoistway can be put to use. At this stage a jump-lift is performed, where the supporting structure is lifted and mounted in a higher position in the elevator hoistway. These steps may be repeated until the desired height has been reached. Elevators often comprise a roping system having one roping suspending the elevator car and the counterweight, and another roping which is suspended by the elevator car and counterweight. This type of setting of the roping system is desirable for numerous reasons, for example because it provides rope weight compensation and it may be used for tie-down function. In jump-lift type elevators having this type of roping system, however, the lifting stage poses challenges. The lifting of the support structure may cause a need to adjust the relative position of the movable elevator units and the roping system. Particularly, in order to maintain the lowest landings within the service zone of the elevator car, a longer roping is needed for suspending the elevator car and the counterweight. Typically, each of said two separate ropings has had a rope supply at an end thereof so as to enable the feeding of more roping to the roping system. The existing solutions have the drawback that they necessitate several ropings the route of which cannot be freely chosen. Also, several rope supplies are needed, the location of which cannot be freely chosen. In particular, the existing solutions are not flexible with regard to the suspension ratios during the construction time. This often means that the elevator must undergo radical changes when converting the construction time elevator into a final elevator, because often the construction time suspension ratio cannot be chosen to be the same as that of the final elevator. The drawbacks related to the suspension ratio are usually caused by the need to position the rope supply separately from the moving elevator units, for example to save energy and space. For this reason the suspension ratio for the elevator car and/or counterweight needs to be 2:1, which leaves the rope ends free to pass to the rope supply which is positioned for example in the pit or on the landing or on the support structure. A later conversion of the elevator into 1:1 suspension ratio then necessitates changing routes of the ropes. It may also necessitate major changes to the shaft layout and structure of the car frame and/or counterweight frame.

BRIEF DESCRIPTION OF THE INVENTION

The object of the invention is to introduce an improved elevator arrangement and method. The object of the invention is, inter alia, to solve drawbacks of known solutions and problems discussed later in the description of the invention. Embodiments are presented which, inter alia, facilitate simple, safe and efficient repositioning of elevator components, such as the relative position of the movable elevator units and the roping system. Also, embodiments are presented where a roping can be connected to a movable elevator unit such that the properties of a suspension ratio 1:1 are achieved without locking the roping end to the elevator unit.

It is brought forward an elevator arrangement. In a preferred embodiment of the invention, the elevator arrangement comprises a first movable elevator unit and a second movable elevator unit, the first movable elevator unit being an elevator car and the second movable elevator unit being a counterweight or vice versa, and a roping system, the roping system comprising

- a first roping portion suspending the first elevator unit and the second elevator unit, and being locked at least to the second elevator unit by a locking arrangement,
- a second roping portion being suspended by the first elevator unit and the second elevator unit, and being locked at least to the second elevator unit.

The first and second roping portions are successive portions of a roping passing unbroken via a locking arrangement provided at the second elevator unit, the locking arrangement locking the roping to the second elevator unit between the first and the second portions. Accordingly, the first and second roping portions are portions of one and the same continuous roping. With this kind of arrangement one or more of the drawbacks can be eliminated. This kind of arrangement brings several advantages, especially it facilitates adjustment of the relative position of the elevator components. Especially, repositioning the roping with respect to the second elevator unit is facilitated. Furthermore, changing the relative position of the elevator units is facilitated since changing the length of one or both of said roping portions is made possible.

In a preferred embodiment, the first and the second roping portion are successive portions of a roping on opposite sides of the locking arrangement, the first portion suspending the second movable elevator unit and the second portion being suspended by the second movable elevator unit.

In a preferred embodiment, the locking arrangement comprises one or more fixing means such as one or more rope clamps provided at the second elevator unit, via which the roping passes unbroken.

In a preferred embodiment, said locking arrangement is a releasable locking arrangement. This means that the locking of the roping can be released (moved to an unlocking condition) without breaking. Preferably, the locking arrangement comprises one or more fixing means such as one or more rope clamps provided at the second elevator unit, via which the roping passes unbroken, and which is/are releasable. The releasable fixing means may be for instance in the form of releasable rope clamp(s). The releasable fixing means preferably comprise rope compressing means, such as a first part and a second part between which a rope or ropes of the roping pass(es) unbroken and between which a rope or ropes of the roping is/are compressed/can be compressed, such as by moving at least one of the first and second parts towards the other. To achieve releasability, the rope compressing means can be moved to an uncompressing state, e.g. by moving at least one of the first and second parts further away from the other for releasing the compression. Then the locking arrangement, in particular the fixing means thereof, e.g. the clamp(s) thereof, is releasable. Thus the position of locking between the first and the second portion can be changed by first releasing the locking arrangement. Accordingly, no breaking of components is necessary.

In a preferred embodiment, the first movable elevator unit is an elevator car and the second movable elevator unit is a counterweight.

In a preferred embodiment, the roping passes at least at one of its ends unbroken to a rope supply storage via releasable fixing means, such as one or more releasable rope clamps via which the second roping portion passes unbroken to a rope supply storage.

In a preferred embodiment, the second roping portion passes around and below one or more lower rope wheels mounted on a building in proximity to the lower end of the traveling zone of the second movable elevator unit, and on one side of the lower rope wheel(s) the second roping portion is suspended by the first movable elevator unit and on the other side of the lower rope wheel(s) the second roping portion is suspended by the second movable elevator unit. Thus the second roping portion can be guided by the rope wheel and function as a tie-down mechanism.

In a preferred embodiment, the second roping portion is suspended by the first elevator unit via a diverter unit, the diverter unit comprising one or more first diverter unit rope wheels around and over which the second rope portion passes. Preferably, the second roping portion extends on one side of the diverter unit rope wheel(s) downwards to a stationary fixing point on the building, such as fixing means mounted stationary on the building, and on the other side to the locking arrangement provided at the second movable elevator unit. Said fixing means mounted stationary on the building are preferably releasable, and the second roping portion preferably passes via said releasable fixing means (such as releasable clamp(s)) unbroken to a rope supply storage.

In a preferred embodiment, the second roping portion is suspended by the first elevator unit via a diverter unit, the diverter unit comprising one or more first diverter unit rope wheels around and over which the second rope portion passes, the diverter unit further comprising one or more second diverter unit rope wheels and being suspended by the first movable elevator unit with a second roping passing under the second diverter unit rope wheel(s), the second roping being arranged to hang between the first elevator unit and a fixing point stationary with respect of the first movable elevator unit, such as a fixing means mounted stationary mounted with respect to the first movable elevator unit. These fixing means are preferably releasable, and the second roping preferably passes via said releasable fixing means (such as releasable clamp(s)) unbroken to a rope supply storage.

In a preferred embodiment, the second roping passes at least at one of its ends unbroken to a rope supply storage via releasable fixing means, such as via one or more releasable clamps.

In a preferred embodiment, the elevator car is in service for transporting passengers and/or goods.

In a preferred embodiment, the elevator arrangement comprises a motorized machinery for moving the elevator units by moving the roping.

In a preferred embodiment, the roping comprises one or more ropes, for example one or more steel wire ropes or one or more belts.

In a preferred embodiment, the elevator arrangement comprises a movable support structure in the hoistway for giving support for the roping system, and being mounted above the elevator car. The support structure is preferably mounted stationary during use, e.g. to rest on structures of the hoistway or components installed inside the hoistway. Preferably, on the support structure, at least one upper rope wheel is mounted around and over which the first roping portion passes.

In a preferred embodiment, the elevator comprises an upper rope wheel, preferably in unity of a support structure, around and over which upper rope wheel the first roping portion passes and on one side of which the elevator car is suspended by the first roping portion and on the other side of which the elevator car is suspended by the first roping portion.

In a preferred embodiment, the elevator arrangement comprises a lifting arrangement for lifting the movable support structure higher in the hoistway.

It is also brought forward a method in constructing an elevator. In a preferred embodiment of the method according to the invention, the elevator is arranged or has earlier been arranged to comprise

- a hoistway;
- a first movable elevator unit and a second movable elevator unit movable in the hoistway, the first movable elevator unit being an elevator car and the second movable elevator unit being a counterweight or vice versa;
- a movable support structure in the hoistway for giving support for a roping system and being mounted above the elevator car, on which support structure at least one upper rope wheel is preferably mounted around and over which the first roping portion passes;
- a roping system comprising
  - a first roping portion suspending the first elevator unit and the second elevator unit, and being locked at least to the second elevator unit at least for the time of using of the elevator car, and
  - a second roping portion being suspended by the first elevator unit and the second elevator unit, and being locked at least to the second elevator unit at least for the time of using of the elevator car.

The method comprises

- using of the elevator car for transporting passengers and/or goods, and thereafter,
- lifting of the movable support structure higher in the hoistway, and thereafter,
- subsequent using of the elevator car for transporting passengers and/or goods.

The first roping portion and the second roping portion are successive portions of a roping passing unbroken via a locking arrangement, which is provided at the second elevator unit for locking the roping between the first and the second portions. The method further comprises (preferably between said using and said subsequent using), unlocking the locking arrangement, and thereafter repositioning the roping with respect to the locking arrangement, and thereafter relocking the locking arrangement.

In a preferred embodiment, said unlocking the locking arrangement, repositioning the roping with respect to the locking arrangement and relocking the locking arrangement are carried out between said using and said subsequent using.

In a preferred embodiment, the unlocking is carried out between said using and said lifting.

In a preferred embodiment, before unlocking is carried out, the second elevator unit is driven to rest on a bottom buffer positioned at the end of the path of travel of the second elevator unit. Thus, the arrangement is safe when the locking arrangement is in an unlocked (released) condition.

In a preferred embodiment, said relocking is carried out between said lifting and said subsequent using.

In a preferred embodiment, said repositioning comprises extending the length of the first roping portion.

In a preferred embodiment, said repositioning comprises moving a length of the roping from one side of the locking arrangement to the other side of the locking arrangement, preferably from the side of the second roping portion to the side of the first roping portion. Thus, part of the second roping portion can be moved to the other side of the locking arrangement to extend the first roping portion longer.

In a preferred embodiment, during said lifting, a suitable length of roping is taken from a rope supply storage to which the roping passes unbroken at one of its ends via a releasable fixing means. During lifting, the locking may be in an unlocked condition.

In a preferred embodiment, the elevator is arranged as defined in any paragraph above.

In a preferred embodiment, the second roping passes unbroken at one of its ends via a releasable fixing means to a rope supply storage, and the method comprises repositioning of the diverter unit relative to said movable elevator units, the repositioning comprising taking a second roping from the rope supply storage.

The features and steps relating to the diverter unit may form a separate invention irrespectively of whether or not the first and second roping portions are part of same roping. Accordingly, a second invention is brought forward where the elevator arrangement comprises a first and a second movable elevator unit, the first movable elevator unit being an elevator car and the second movable elevator unit being a counterweight or vice versa, and a roping system. The roping system comprises a first roping portion suspending the first elevator unit and the second elevator unit, and a second roping portion suspended by the first elevator unit and the second elevator unit. The second roping portion is locked to the second movable elevator unit and suspended by the first movable elevator unit via a diverter unit, the diverter unit comprising one or more first diverter unit rope wheels around and over which the second rope portion B passes, the diverter unit further comprising one or more second diverter unit rope wheels and being suspended by the first movable elevator unit with a roping (in other embodiments referred to as a second roping) passing around and under the second diverter unit rope wheel(s), the roping being arranged to hang between first elevator unit and a fixing point stationary with respect to the movable elevator units, such as fixing means mounted stationary with respect to the movable elevator units. The second roping portion can thus pass for example to a rope supply storage separate from the movable elevator units without reducing the overall suspension ratio. This also makes it possible that the overall suspension ratios on the side of both first and second elevator unit can be formed mutually same and 1:1. This way a construction time elevator is easy to modify into the final elevator having 1:1 suspension ratios, because the layout and the structures need not be widely modified so as to compensate for necessary changes in the suspension ratios. Preferably, the second roping portion passes unbroken to a rope supply storage via releasable fixing means such as a releasable rope clamp. Thus, the second roping portion can be extended simply. Preferably, the fixing means are releasable and said roping hanging between the first elevator unit and a stationary fixing point passes unbroken to a rope supply storage via the releasable fixing means. Thus, the diverter unit can be repositioned and additional rope can be fed to the roping system. Preferably, the second roping portion passes around one or more lower rope wheels mounted on the building, and on one side of the lower rope wheel(s) the second roping portion is suspended by the second movable elevator unit and on the other side of the lower rope wheel(s) the second roping portion is suspended by the first elevator unit via the diverter unit. Preferably, the second roping portion passes on one side of the diverter unit rope wheel(s) down to releasable fixing means mounted stationary on the building, and on the other side (down to the lower rope wheels and further) to the second elevator unit to which it is locked. Preferably, the first roping portion passes around and over one or more upper rope wheels and on one side of the upper rope wheel(s) the elevator car is suspended by the first roping portion A and on the other side of the upper rope wheel(s) the counterweight is suspended by the first roping portion, and the suspension ratios are the same on opposite sides of the upper rope wheel(s). Preferably, the second roping portion passes unbroken to a rope supply storage via releasable fixing means.

Any one of the elevator arrangements described above is preferably installed inside a building, the car traveling vertically. The hoistway is preferably formed to be located inside the building. Preferably, the car has an interior space suitable for receiving a passenger or passengers. The car is preferably arranged to serve two or more landings. The car preferably responds to landing calls and/or car calls so as to serve persons on the landing(s) and/or inside the elevator car. These qualities are preferably present also in the final and permanently present elevator constructed by the method/elevator arrangement. The building may be a tower building or some other type of building.

BRIEF DESCRIPTION OF THE DRAWINGS

In the following, the present invention will be described in more detail by way of example and with reference to the attached drawings, in which.

DETAILED DESCRIPTION

Figure 1:
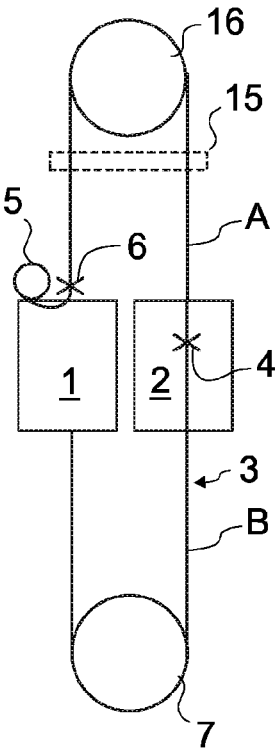
FIG. 1 illustrates an elevator arrangement according to an embodiment of the invention where method steps of the invention can be performed.
Figure 2:
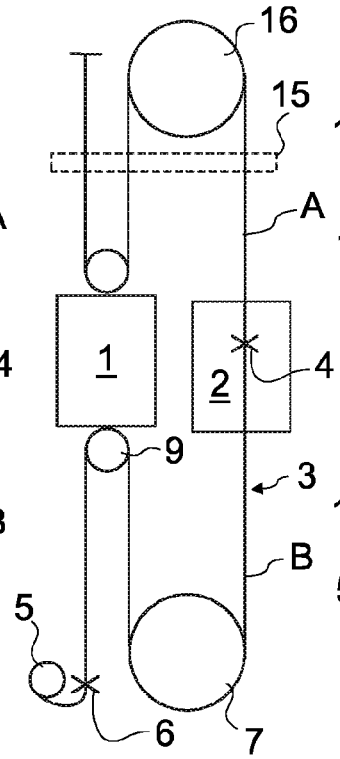
FIG. 2 illustrates an elevator arrangement according to another embodiment of the invention where method steps of the invention can be performed.
Figure 3:
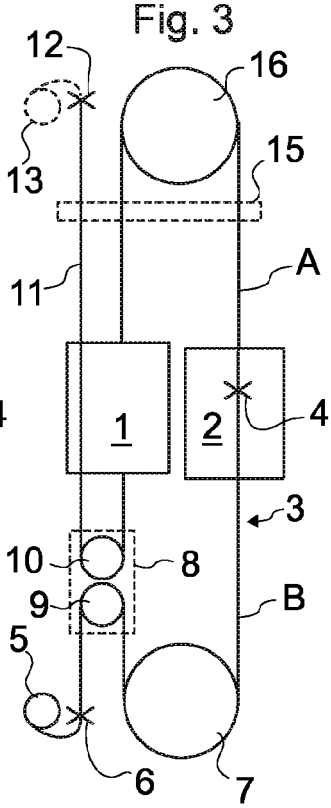
FIG. 3 illustrates an elevator arrangement according to yet another embodiment of the invention where method steps of the invention can be performed.

FIGS. 1 to 3 illustrate alternative preferred embodiments in each of which an elevator arrangement is arranged to comprise a first movable elevator unit 1 and a second movable elevator unit 2, the first elevator unit being an elevator car and the second elevator unit being a counterweight or vice versa, and a roping system. The roping system comprises a first roping portion A suspending the first elevator unit 1 and the second elevator unit 2, and the first roping portion A is locked to the second elevator unit 2 so as to enable said suspension of the second elevator unit 2. The roping system further comprises a second roping portion B which is suspended by the first elevator unit 1 and the second elevator unit 2, and which is locked to the second elevator unit 2 so as to enable said suspension by the second elevator unit 2. The first and the second roping portions A, B are successive portions of a roping 3 passing unbroken via a locking arrangement 4 provided at the second elevator unit 2, the locking arrangement 4 locking the roping 3 to the second elevator unit 2 between the first and the second portion A, B. Accordingly, the first and the second roping portions are successive portions of a roping on opposite sides of the locking arrangement 4, the first portion A suspending the second movable elevator unit 2 and the second portion B being suspended by the second movable elevator unit 2. Thus, the roping portions A and B need not be separate ropings but may be portions of one and the same continuous roping. This makes it possible to adjust the relative position of the elevator components more easily. In particular, the length of the first roping portion A and the length of the second roping portion B can be changed when necessary during elevator modification. The relative lengths of the roping portions A and B can be adjusted by repositioning the locking arrangement 4 and the roping 3 with respect to each other. In particular, this can be carried out merely by changing the point of locking. These advantages are due to the roping 3 continuing unbroken via the locking arrangement. This also makes it possible to lengthen the traveling zone of the elevator car 1 simply. For example, the car traveling zone can be lengthened by feeding more roping to the roping system and by readjusting the relative position of the roping 3 and the second elevator unit 2. The lengths of both of the portions A, B can be increased even by feeding more roping to the roping system from one point only, e.g. from a rope supply storage at only one end of the roping 3.

Said locking arrangement 4 is preferably a releasable locking arrangement. This means that the locking of the roping 3 can be released without breaking the locking arrangement or the roping 3. Preferably, to achieve said releasability, the locking arrangement 4 comprises one or more releasable fixing means such as releasable rope clamp(s) mounted on the second elevator unit 2, via which the roping passes unbroken. The clamp or clamps may be formed such that the clamp or each clamp comprises rope compressing means, such as a first part 21 and a second part 22 between which a rope or ropes of the roping 3 pass(es) unbroken and between which a rope or ropes of the roping 3 is/are compressed/can be compressed by moving at least one of the first and second parts towards the other. To achieve releasability, the rope compressing means can be moved to an uncompressing state, e.g. by moving at least one of the first and the second part further away from the other for releasing the compression. Then the locking arrangement, in particular the clamp thereof, is releasable and thus the position of locking between the first and the second portion can be changed by first releasing the locking arrangement.

The roping 3 passes at one of its ends unbroken to a rope supply storage 5 via releasable fixing means 6, such as one or more releasable clamps via which releasable clamp(s) the second roping portion passes unbroken to a rope supply storage. The releasable clamp(s) may be formed as previously described in connection with the clamp(s) of the locking arrangement 4.

It is preferable, although not necessary, that the second roping portion B passes around and below a lower rope wheel 7 mounted on the building in proximity to the lower end of the traveling zone of the second movable elevator unit, and on one side of the lower rope wheel 7 the second roping portion B is suspended by the first movable elevator unit 1 and on the other side of the lower rope wheel 7 the second roping portion B is suspended by the second movable elevator unit 2. Thus the second roping portion B can be guided by the rope wheel and the second roping portion B can together with the lower rope wheel 7 provide a tie-down function for the elevator. If the rope wheel 7 is omitted, the second roping portion may hang freely in the hoistway.

The elevator is depicted in FIGS. 1 to 3 in a state where the elevator car is or can be in service for transporting passengers and/or goods.

For the purpose of enabling changes (particularly extending) of the service zone, the elevator arrangement preferably comprises a movable support structure 15 in the hoistway for giving support for the roping system, which is mounted above the elevator car 1. During use of the elevator car the support structure 15 is stationary. On the support structure, at least one upper rope wheel 16 is mounted around and over which the first roping portion A passes. This rope wheel 16 can transmit the supporting force from the building to the roping system via the support structure 15. On one side of the rope wheel 16 the elevator car 1 is suspended by the first roping portion A and on the other side of the rope wheel 16 the counterweight 2 is suspended by the first roping portion A. Also for the purpose of changing the service zone, the elevator arrangement preferably comprises a lifting arrangement for lifting the movable support structure 15 higher in the hoistway S. This may be in the form of a crane connected/connectable to lift the support structure 15. Alternatively, this may be in the form of an additional support structure (not shown) mounted in the hoistway S and a lifting device for lifting the support structure 15 by taking support from said additional support structure e.g. via a lifting rope or equivalent.

As mentioned above, the support structure 15 is preferably movable. This means that it is demountably supportable in different vertical positions in the hoistway S. For this purpose, the construction-time elevator has preferably been arranged to comprise supporting means t for supporting the support structure 15 stationary in the elevator hoistway S, which means t are transferable between state I where the support structure 15 is supported stationary, and state II, where the support structure 15 is not supported stationary. When in state II, the supporting means t do not block upwards-directed vertical movement of the support structure 15 in the hoistway S. The supporting means t preferably comprise laterally extendable support elements (for example as shown in the drawings) mounted on the support structure 15. When in supporting state I, each support element may extend on top of a stationary supporting structure of the elevator, such as an upper surface of an elevator hoistway structure or a sill of the landing door opening. For this purpose, the hoistway S may be designed to have supporting structures at intervals. For instance, pockets can be made in the hoistway walls. The support elements can be formed to be laterally extendable (and retractable back to a non-extended state) by linear movement (as drawn in Figures) or by pivoting. Alternatively, the supporting means t could have a different design. A preferred alternative design would be such that the means t are gripping means arranged to grip elevator guide rails when in state I and not grip when in state II. Such gripping means would preferably be in the form of a wedging-type gripper, having a wedging part arranged to wedge between a guide rail and an upwardly-tapering housing surface of the gripper if the gripping means move downwards, thus utilizing a structure well known from elevator safety gear devices.

For the purpose of moving the movable elevator units 1 and 2 the elevator arrangement preferably comprises a motorized machinery (not shown) for moving the elevator units 1,2 by moving the roping 3. The machinery can be located on the support structure 15. Then for instance a rope wheel 16 on the support structure 15 may form a traction sheave of the machinery, but alternative positions are also available. Said roping 3 comprises one or more ropes, for example one or more steel wire ropes or one or more belts. It is preferable though, that the roping comprises a plurality of ropes. Thus, the locking is easier to carry out without harming the ropes e.g. compressing marks can be avoided.

In a first preferred embodiment (now referring particularly to the embodiment as shown in FIG. 1), both ends of the roping 3 are in the unity of the first elevator unit. The first roping portion A is locked to the first elevator unit and to the second elevator unit 2 on opposite sides of the upper diverting wheel 16. Correspondingly, the second roping portion A is locked to the first elevator unit and to the second elevator unit 2 on opposite sides of the lower diverting wheel 7. As the first and the second roping portions A,B are successive portions of a roping 3, which passes unbroken via the locking arrangement 4 provided at the second elevator unit 2, the locking arrangement 4 locking the roping to the second elevator unit 2 between the first and the second portions A,B, the roping 3 departs from the first elevator unit and returns to it after looping elevator diverting wheel(s) and after passing via the locking arrangement 4. The suspension ratio of the movable elevator units 1 and 2 is 1:1 with both the first and the second roping portions A,B. Accordingly, it is simple to later convert this roping into a final roping having 1:1 ratio. In this embodiment, the rope supply storage 5 and the releasable fixing means 6 are both in the unity of the first elevator unit. Preferably, the first movable elevator unit 1 is an elevator car and the second movable elevator unit 2 is a counterweight. Thus, the rope supply storage 5 is simple to position and easy to access.

In a second preferred embodiment (now referring particularly to the embodiment as shown in FIG. 2), both ends of the roping 3 pass to fixing means separate from the movable elevator units 1,2. Said fixing means are preferably mounted stationary on the building. At least one of the fixing means is a releasable fixing means 6 via which the roping passes to a rope supply storage 5. In this embodiment, the rope supply storage 5 is stationary relative to the movable elevator units 1, 2, preferably close to the lower end of the hoistway. Accordingly, it is preferable that it is the second roping portion that passes from the first elevator unit to the rope supply storage. The first roping portion A is locked to the second elevator unit by the locking arrangement 4 as described above and to the first elevator unit it is connected via a diverting wheel via which the first roping portion A suspends the first movable elevator unit 1. Correspondingly, the second roping portion B is locked to the second elevator unit by the locking arrangement 4 as described above, and to the first elevator unit it is connected via a diverting wheel suspending the first roping portion A. Accordingly, the suspension ratio of each portion A,B is 1:1 on the side of the second movable elevator unit 2 and 2:1 on the side of the first movable elevator unit 1. An advantage of this embodiment is, inter alia, that the rope supply storage 5 is simple to position and safe to access. It can also be mounted stationary, thus saving energy.

In a third preferred embodiment (now referring particularly to embodiment as shown in FIG. 3), one end of the roping 3 is in the unity of the first elevator unit and the other is separate from both of the movable elevator units 1 and 2. The first roping portion A is locked to the first elevator unit and to the second elevator unit 2 so as to enable suspension thereof. As mentioned above, the first and the second roping portions A,B are successive portions of a roping 3, which passes unbroken via the locking arrangement 4 provided at the second elevator unit 2 for providing locking of the roping to the second elevator unit 2 between the first and the second portions A,B. The second roping portion B is locked to the second elevator unit and is suspended by the second elevator unit 2, especially by the locking arrangement 4. The second roping portion B is also suspended by the first elevator unit 1. However, the suspension by the first elevator unit is carried out as indirect suspension via a diverter unit 8, the diverter unit 8 comprising a first diverter unit rope wheel 9 around and over which the second rope portion B passes. On one side of the diverter unit rope wheel 9, the second roping portion B extends downwards to a stationary fixing point on the building, such as fixing means 6 mounted stationary on the building, and on the other side to the locking arrangement 4 provided at the second movable elevator unit 2. Between the diverter unit 8 and the locking arrangement 4 the second roping portion hangs in the hoistway, preferably passing around and below the lower diverting wheel 7. The diverter unit 8 further comprises a second diverter unit rope wheel 10 and is suspended by the first movable elevator unit 1 with a second roping 11 passing under the second diverter unit rope wheel 10, the second roping 11 being arranged to hang between the first elevator unit 1 and a fixing point stationary with respect to the first movable elevator unit 1, such as fixing means 12 mounted stationary with respect to the movable elevator units 1, 2. The diverter unit 8 is not mounted stationary and it moves when the movable elevator units 1 and 2 move. Said fixing means 12 are preferably releasable and the second roping 11 passes unbroken to a rope supply storage 13 via these releasable fixing means 12. Thus the position of the diverter unit 8 can be adjusted by feeding rope to or unwinding rope from the rope supply storage 13. Preferably, the releasable fixing means 12 comprise one or more releasable rope clamps. The presence of the diverter unit 8 has numerous advantages, especially when it is suspended by the roping 11 passing to a rope supply. Lowering the diverter unit in respect of the first elevator unit makes it possible to compensate for the need for additional length of the roping system caused by the lifting of the support structure 15. It may even be that no rope supply is necessary at either end of the roping 3. Also other types of modifications of the relative positions of the elevator units 1 and 2 are made easy by the diverter unit when the roping 11 has a rope supply storage 13 at its end. Advantages are achieved also if no rope supply storage 13 is provided at the end of the roping 11, though. Namely, the diverter unit 8 makes it possible that the roping 3 can be connected to suspend from the first elevator unit 1 via a rope wheel 9 and yet the 1:1 overall suspension ratio on the side of the first elevator unit 1 can be achieved. This is because the suspension ratio with which the first elevator unit 1 suspends the diverter unit 8 eliminates the suspension ratio change otherwise caused by suspension of the roping 3 via the rope wheel 9. The roping 3 can thus pass to a fixing point stationary with respect to the movable elevator units 1 and 2 without changing the overall suspension ratio on the side of the first elevator unit. The roping 3 can thus pass for example to a rope supply storage 5 separate from the movable elevator units 1 and 2 without reducing the suspension ratio. This also makes it possible that the overall suspension ratios on the side of both the first and the second elevator unit can be formed mutually same and 1:1. This way a construction-time elevator is easy to modify into the final elevator having 1:1 suspension ratios, because the layout and the structures need not be widely modified so as to compensate for necessary changes in suspension ratios.

Figure 4:
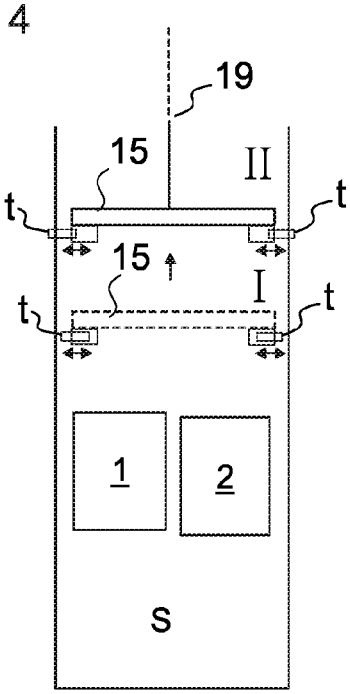
FIG. 4 illustrates an elevator arrangement when method steps of the invention are being performed.

FIG. 4 shows a lifting step according to an embodiment of the method. Some of the details are not shown (for example the roping system). As to details of implementation (which are not shown in FIG. 4), the elevator structure is preferably as disclosed in any one of FIGS. 1 to 3 and the related description. In the following, the method is described referring to FIGS. 1 to 4. The method is part of a method of constructing an elevator. The elevator is arranged to comprise during construction-time a hoistway S; a first movable elevator unit 1 and a second movable elevator unit 2 movable in the hoistway, the first elevator unit being an elevator car and the second elevator unit being a counterweight or vice versa; and a movable support structure 2 in the hoistway for giving support for a roping system 3 and being mounted above the elevator car 1 on which support structure at least one upper rope wheel is mounted around and over which the first roping portion A passes. The roping system 3 comprises

- a first roping portion A suspending the first elevator unit 1 and the second elevator unit 2, and being locked at least to the second elevator unit 2 at least for the time of using of the elevator car, and
- a second roping portion B being suspended by the first elevator unit 1 and the second elevator unit 2, and being locked at least to the second elevator unit 2 at least for the time of using of the elevator car.

The method comprises the step of using of the elevator car 1 for transporting passengers and/or goods, and thereafter the step of lifting of the movable support structure 2 higher in the hoistway, and thereafter the step of subsequent using of the elevator car 1 for transporting passengers and/or goods. The first and the second roping portions A, B are successive portions of a roping 3 passing unbroken via a locking arrangement 4, which is provided at the second elevator unit 2 for locking the roping 3 between the first and the second portions. The method further comprises between said using and said subsequent using the steps of unlocking the locking arrangement 4, and thereafter the step of repositioning the roping 3 with respect to the locking arrangement 4, and thereafter the step of relocking the locking arrangement 4. In this way, the lengths of the roping portions A and B can be changed.

Said lifting may be carried out at a suitable moment, e.g. when the hoistway under construction above the service zone of the elevator has been completed. Step cycles involving said lifting may be repeated until a desired height is reached. Preferably, the elevator car is always taken out of said use before lifting and returned to said use after said lifting.

Preferably during said lifting a suitable length of roping 3 is taken, e.g. by unwinding, from a rope supply storage 5 to which the roping 3 passes unbroken at one of its ends via releasable fixing means 6. Thus, additional roping needed for the lifting can be taken from the rope supply storage 5 during the lifting. Said unlocking of the locking arrangement 4 is preferably carried out between said using and said lifting. Thus the roping 3 lengths can be adjusted to suitable lengths so that the relative positions before and after the lifting are as desired. Having the locking opened at the time of the lifting enables that the roping 3 repositions automatically relative to the locking arrangement 4, and also relative to the second elevator unit 2. Preferably, the first elevator unit 1 (preferably a car) is during lifting fixed to the support structure 15 and thus arranged to raise along with the support structure 15 in said lifting. The second elevator unit 2 (preferably a counterweight) can rest 15 on the bottom buffer of the elevator (not shown) when the lifting of the support structure is completed. Thus, the arrangement is safe when the locking arrangement is in an unlocked (released) condition. Also, the lengths of the roping portions A and B can adjust automatically to a length preferred for the next period of using the elevator for transporting passengers and/or goods.

In a preferred embodiment, the repositioning of the roping 3 with respect to the locking arrangement 4 comprises moving a length of the roping from one side of the locking arrangement to the other side of the locking arrangement. The purpose being to extend the service zone of the elevator car, the repositioning comprises extending the length of the roping portion A. This is preferably carried out by moving a length of the roping from the side of the second roping portion B to the side of the first roping portion A. The relocking is preferably carried out between said lifting and said subsequent using. Accordingly, the system can be brought after the lifting back to a condition where it can be used for transporting passengers and/or goods.

When the method is utilized in an elevator arrangement as disclosed in FIG. 3 a diverter unit 8 forming part of the arrangement is provided, as described above. In such a case, a second roping 11 suspending the diverter unit 8 and passing unbroken at one of its ends via a releasable fixing means 14 to a rope supply storage 13 is provided. Also in this case, the method may be as described above. However, the method preferably comprises repositioning of the diverter unit in respect of said movable elevator units, the repositioning comprising taking the second roping 11 (i.e. a certain length thereof) from a rope supply storage 13. Thus the length of the second roping 11 can be increased and the diverter unit can be positioned lower from the support points of the second roping 11. A corresponding, but opposite, effect would be achieved by feeding a length of the roping 11 to the rope supply storage 13 instead of taking a length of roping from the rope supply storage 13. Thus, the position of the diverter unit relative to the movable elevator units can be adjusted. The repositioning by taking second roping from the rope supply storage 13 may be used for providing some additional rope for the roping system and it may even make it possible that the length of roping 3 need not be increased owing to lifting. Accordingly, a lifting step of the like as described may be carried out even without taking any rope from the rope supply storage 5. The repositioning of the diverter unit is preferably carried out between said using and said subsequent using. For example the sequence may be such that after said using the releasable fixing means 14 are opened and some rope is taken from the rope supply storage 13 such that the second roping has an excessive length and thereafter the releasable fixing means are closed and thereafter the support structure 15 is lifted and thereafter the rope lengths are fineadjusted.

Figure 5:
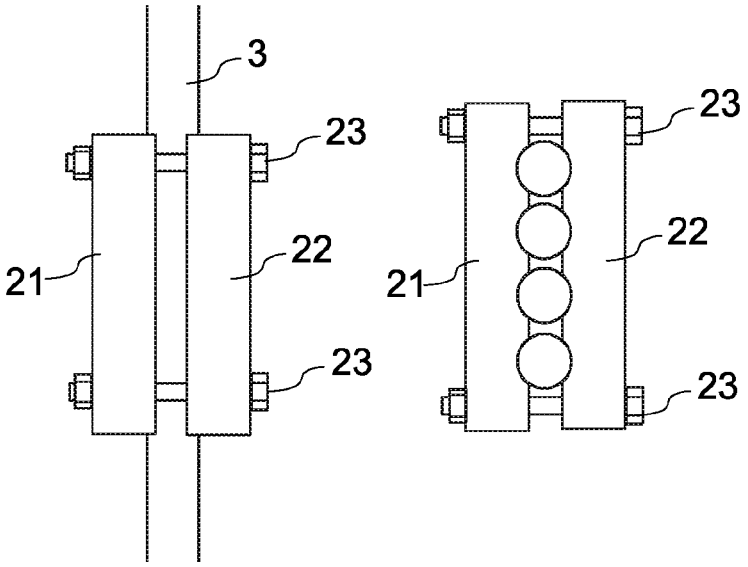
FIG. 5 illustrates releasable fixing means.

As above described, a locking arrangement 4 is provided at the second elevator unit. Accordingly, the second movable elevator unit 2 is provided with the locking arrangement 4. This can be realized by mounting the locking arrangement 4 on the second movable elevator unit 2. FIG. 5 illustrates a preferred embodiment of the locking arrangement 4 when it is a releasable locking arrangement. In particular, FIG. 5 illustrates a releasable fixing means, in this case a releasable rope clamp. To achieve releasability, the locking arrangement 4 may comprise this type of releasable fixing means. The locking arrangement 4 is mounted on the second movable elevator unit 2 (not shown in FIG. 5) so that it moves along with the second elevator unit and can lock the second movable elevator unit 2 to the roping 3. The ropes (in this example, a plurality of ropes) of the roping 3 pass unbroken via the locking arrangement 4. The clamp comprises rope compressing means 21, 22, 23 having a first part 21 and a second part 22 between which a rope or ropes of the roping 3 passes unbroken and between which a rope or ropes of the roping 3 is/are compressed/can be compressed so as to achieve the locking effect by moving at least one of the first and the second parts 21, 22 towards the other. To achieve releasability, the rope compressing means can be moved to an uncompressing state, e.g. by moving at least one of the first and the second parts further away from the other for releasing the compression. For this purpose, the compressing means comprise a tightener 23, which may be in the form of a screw tightener, such as a bolt-and-nut pair as depicted. The releasable fixing means 6, 12 and 18 may each have a structure as described here.

In most of the depicted embodiments, the roping 3 passes straight via the locking arrangement 4, particularly via a clamp thereof. However, this is not necessary because the locking arrangement may route the roping 3 into any convenient route. Also, the locking arrangement may even store an additional length of the roping inside it, for example between two rope clamps comprised in the locking arrangement 4. This way the roping 3 can be routed for example around some structures of the elevator unit.

Figure 6:
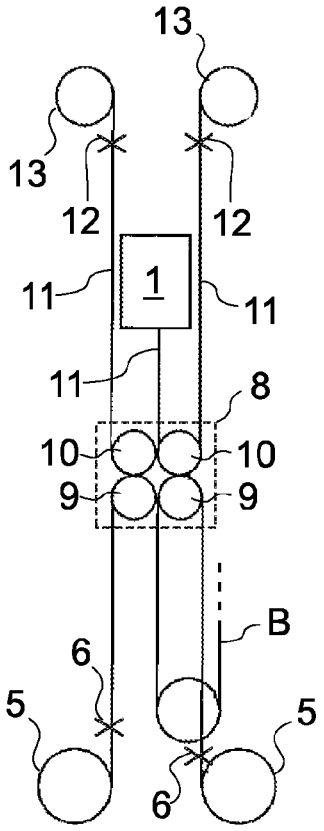
FIG. 6 illustrates a preferred configuration of a diverter unit.

FIG. 6 shows a preferred configuration of the diverter unit. This configuration can be used in any one of the embodiments having a diverter unit 8. In this configuration, the diverter unit comprises a plurality of second diverter unit rope wheels 10 and a plurality of first diverter unit rope wheels 9. The ropes of the second roping portion B are guided to split and pass around and over said plurality of first diverter unit rope wheels 9 placed side by side. The second roping portion B arrives at said diverter unit rope wheels 9 (between them) as one dense array and leaves them split into two separate arrays. The first diverter unit rope wheels 9 each guide half of the ropes of the second roping portion. The second roping 11 is guided in a corresponding manner. The ropes of the second roping portion B are guided to split and pass around and over said plurality of first diverter unit rope wheels 9 placed side by side. The second roping 11 arrives at said second diverter unit rope wheels 10 (between them) as one dense array and leaves them split into two separate arrays. The second diverter unit rope wheels 10 each guide half of the ropes of the second roping. The effect of this type of configuration is that the rope forces on both sides of the diverter unit 8 are equal. Also, the ropes can be guided to pass to and from the diverter unit on opposite sides of the first movable elevator unit 1.

Figure 7:
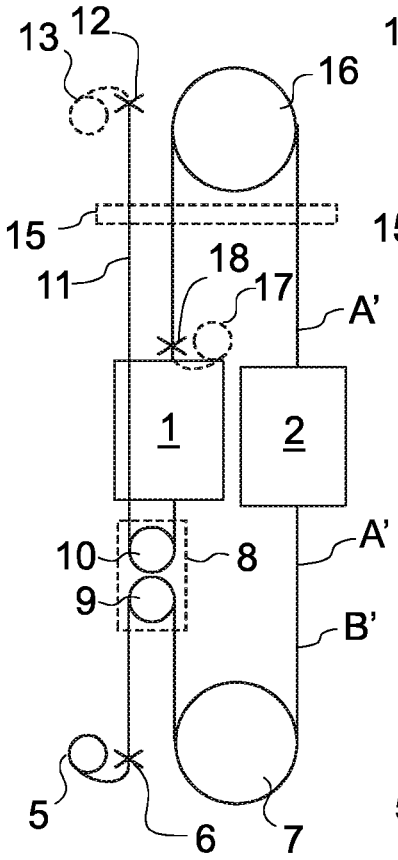
FIGS. 7 and 8 illustrate further elevator arrangements where a diverter unit can be used.
Figure 8:
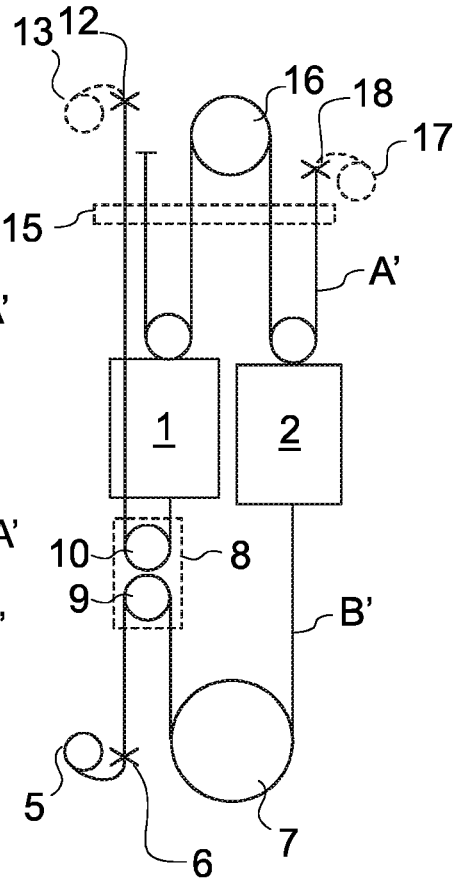

FIGS. 7 and 8 illustrate further embodiments showing additional ways of implementing the diverter unit. In particular FIGS. 7 and 8 show the diverter unit 8 implemented in an elevator arrangement where the first and the second roping portions of the roping system are not part of the same roping. In these embodiments, the elevator arrangement comprises a first and a second movable elevator unit 1 and 2, the first movable elevator unit 1 being elevator car and the second movable elevator 2 unit being a counterweight or vice versa, and a roping system, the roping system comprising a first roping portion A' suspending the first elevator unit and the second elevator unit, a second roping portion B' suspended by the first elevator unit and the second elevator unit. The second roping portion B' is locked to the second movable elevator unit 2 and suspended by the first movable elevator unit 1 via a diverter unit 8, the diverter unit comprising one or more first diverter unit rope wheels 9 around and over which the second rope portion B' passes, the diverter unit 8 further comprising one or more second diverter unit rope wheels 10 and being suspended by the first movable elevator unit 1 with a roping 11 passing around and under the second diverter unit rope wheel(s) 10, the roping 11 being arranged to hang between the first movable elevator unit 1 and a fixing point stationary with respect to the movable elevator units 1, 2, such as fixing means 12 mounted stationary with respect to the movable elevator units 1 and 2. The second roping portion passes around one or more lower rope wheels 7 mounted on the building, and on one side of the lower rope wheel(s) 7 the second roping portion is suspended by the second movable elevator unit and on the other side of the lower rope wheel(s) the second roping portion is suspended by the first elevator unit via the diverter unit 8. The second roping portion B' passes on one side of the diverter unit rope wheel(s) down to a releasable fixing means mounted stationary on the building, and on the other side down to the lower rope wheels and further to the second elevator unit to which it is locked. The second roping portion B' passes unbroken to a rope supply storage 5 via the releasable fixing means 6 which may be in the form of a releasable rope clamp or in any other means providing an equivalent effect. The first roping portion A' passes around and over one or more upper rope wheels 16, and on one side of the rope wheel 16 the elevator car 1 is suspended by the first roping portion A' and on the other side of the rope wheel 16 the counterweight 2 is suspended by the first roping portion A'. The suspension ratios are the same on opposite sides of the upper rope wheel(s) 16. FIG. 7 illustrates these suspension ratios being 1:1 and FIG. 8 illustrates these suspension ratios being 2:1. Owing to similar suspension ratios, the movable elevator units can move at the same speed and their traveling zones can have similar heights. The same benefits are achieved with the roping portion B', because the diverter unit 8 enables similar overall suspension ratios even though one end of the roping portion B' passes to a stationary fixing means and the other end is in unity of a movable elevator unit. For the purpose of enabling extension of rope lengths, e.g. when lifting the supporting structure 15, both the first roping portion and the second roping portion preferably pass unbroken to a rope supply storage 5,17 via a releasable fixing means 6,18. In order to enable repositioning of the diverter unit in respect of said movable elevator units, it is preferable that the roping 11 passes unbroken at one of its ends via a releasable fixing means 12 to a rope supply storage 13. The repositioning of the diverter unit may be as described above. The method steps (e.g. related to lifting) can in the case of a solution as illustrated in FIG. 7 or 8 be carried out in a manner corresponding to that described in other embodiments, except that steps related to unlocking and repositioning of roping and relocking can be omitted.

In the application, the term locking refers to a condition where the entities being locked are immovable relative to each other. For example, the first and the second roping portions (A,B) are locked to the second elevator unit 2 by the locking arrangement 4 provided at the second elevator unit which means that these roping portions (A,B) are immovable relative to the second elevator unit 2.

The elevator arrangement as described is well suitable for methods involving changing an elevator structure, especially for any method where relative positions of installed elevator components are changed by moving components vertically relative to each other, especially when the components are components for guiding ropes, for suspending ropes or being suspended by ropes. The elevator arrangement is especially suitable for methods where the elevator service zone is to be extended higher, for example in connection with so called jump lifts.

The movable support structure 15 is shown in broken line as it is not absolutely necessary for implementing all the embodiments of the invention. Any one or all of the rope wheels may be in the form of diverting pulleys, as is common in elevators. The diverter unit 8 can be formed to have a frame on which the first and the second diverter unit rope wheel(s) is/are mounted.

In principle, it is possible to form the elevator such that the first movable elevator unit 1 is an elevator car and the second movable elevator unit is a counterweight 2 or vice versa. However, it is preferable that the first movable elevator unit 1 is an elevator car and the second movable elevator unit is a counterweight 2, because it is easier to arrange the locking arrangement 4 in unity of the counterweight. In principle, it is also possible that both of the movable elevator units are elevator cars instead of one being a counterweight.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator arrangement comprising:

a first movable elevator unit; and a second movable elevator unit, the first movable elevator unit being an elevator car and the second movable elevator unit being a counterweight or vice versa; and a roping system, the roping system comprising:

a first roping portion suspending the first movable elevator unit and the second movable elevator unit, and being locked at least to the second movable elevator unit; and a second roping portion being suspended by the first movable elevator unit and the second elevator unit, and being locked at least to the second movable elevator unit, wherein the first roping portion and second roping portion are successive portions of a roping passing unbroken via a locking arrangement provided at the second elevator unit the locking arrangement locking the roping to the second elevator unit between the first and the second roping portions, wherein the second roping portion is suspended by the first elevator unit via a diverter unit comprising one or more first diverter unit rope wheels around and over which the second roping portion passes, the diverter unit being movably suspended by the first elevator unit, a position of the diverter unit along the roping system being adjustable, and wherein the diverter unit is further suspended by a third roping portion to a rope supply storage, the third roping portion hanging between a bottom of the first movable elevator unit and the rope supply storage arranged above the first movable elevator unit.

2. The elevator arrangement according to claim 1, wherein the locking arrangement comprises one or more fixing members provided at the second elevator unit, via which the roping passes unbroken.

3. The elevator arrangement according to claim 2, wherein the one or more fixing members are one or more rope clamps.

4. The elevator arrangement according to claim 1, wherein said locking arrangement is a releasable locking arrangement comprising one or more releasable fixing members.

5. The elevator arrangement according to claim 1, wherein the first movable elevator unit is an elevator car and the second movable elevator unit is a counterweight.

6. The elevator arrangement according to claim 1, wherein the roping passes at one of its ends unbroken to a rope supply storage via a releasable fixing member.

7. The elevator arrangement according to claim 1, wherein the second roping portion passes around and below one or more lower rope wheels mounted on a building, and on one side of the lower rope wheel(s) the second roping portion is suspended by the first movable elevator unit and on the other side of the lower rope wheel(s) the second roping portion is suspended by the second movable elevator unit.

8. The elevator arrangement according to claim 1, wherein the second roping portion extends on one side of the diverter unit rope wheel(s) downwards to a stationary fixing point on the building, and on the other side to the locking arrangement provided at the second movable elevator unit.

9. The elevator arrangement according to claim 1, wherein the diverter unit further comprises one or more second diverter unit rope wheels and being suspended by the first movable elevator unit with the third roping passing around and under the second diverter unit rope wheel(s), the third roping being arranged to hang between the first movable elevator unit and a fixing point stationary with respect to the first movable elevator unit.

10. The elevator arrangement according to claim 1, wherein the second roping passes at one of its ends unbroken to a second rope supply storage via a releasable fixing member.

11. The elevator arrangement according to claim 1, further comprising a movable support structure for giving support for the roping system, which is mounted in a hoistway above the elevator car.

12. The elevator arrangement according to claim 1, further comprising a lifting arrangement for lifting the movable support structure higher in a hoistway.

13. The elevator arrangement according to claim 1, the diverter unit comprises a first diverter unit rope wheel around and over which the second rope portion passes to a first stationary fixing point on the building arranged below the first movable elevator unit, and a second diverter unit rope wheel suspended by the first movable elevator unit with the third roping portion passing around and under the second diverter unit rope wheel, the third roping portion being arranged to hang between the first movable elevator unit and a second stationary fixing point on the building arranged above the first movable elevator unit.

14. A method in constructing an elevator, the elevator comprising:

a first movable elevator unit and a second movable elevator unit, the first movable elevator unit being an elevator car and the second movable elevator unit being a counterweight or vice versa;

a movable support structure for giving support for a roping system and being mounted above the elevator car; and a roping system comprising:

a first roping portion suspending the first elevator unit and the second elevator unit, and being locked at least to the second elevator unit at least for the time of using of the elevator car; and a second roping portion being suspended by the first elevator unit and the second elevator unit, and being locked at least to the second elevator unit at least for the time of using of the elevator car, wherein the first roping portion and second roping portion are successive portions of a roping passing unbroken via a locking arrangement provided at the second elevator unit the locking arrangement locking the roping to the second elevator unit between the first and the second roping portions, wherein the second roping portion is suspended by the first elevator unit via a diverter unit comprising one or more first diverter unit rope wheels around and over which the second roping portion passes, the diverter unit being movably suspended by the first elevator unit, a position of the diverter unit along the roping system being adjustable, and wherein the diverter unit is further suspended by a third roping portion to a rope supply storage, the third roping portion hanging between a bottom of the first movable elevator unit and the rope supply storage arranged above the first movable elevator unit, the method comprising:

using the elevator car for transporting passengers and/or goods, and thereafter, lifting the movable support structure higher, and thereafter, subsequently using the elevator car for transporting passengers and/or goods, wherein the first and the second roping portion are successive portions of a roping passing unbroken via a locking arrangement provided at the second elevator unit for locking the roping between the first and the second portions, the method further comprising the steps of:

unlocking the locking arrangement, and thereafter repositioning the roping with respect to the locking arrangement and thereafter relocking the locking arrangement.

15. The method according to claim 14, wherein said unlocking the locking arrangement, repositioning the roping with respect to the locking arrangement and relocking the locking arrangement are carried out between said using and said subsequent using.

16. The method according to claim 14, wherein the repositioning comprises extending length of the first roping portion.

17. The method according to claim 14, wherein during said lifting, a length of roping is taken from a rope supply storage to which the roping passes unbroken at one of its ends via a releasable fixing member.

18. The method according to claim 14, wherein the locking arrangement comprises one or more fixing members provided at the second elevator unit, via which the roping passes unbroken.

19. The method according to claim 14, wherein the diverter unit further comprises one or more second diverter unit rope wheels and being suspended by the first movable elevator unit with the third roping passing around and under the second diverter unit rope wheel(s), the third roping being arranged to hang between the first movable elevator unit and a fixing point stationary with respect to the first movable elevator unit, and wherein the second roping passes unbroken at one of its ends via a releasable fixing member to a rope supply storage, and the method comprises repositioning of the diverter unit in respect of said movable elevator units, the repositioning comprising taking second roping from the rope supply storage.

20. The method according to claim 14, wherein the steps of unlocking the locking arrangement, and thereafter repositioning the roping with respect to the locking arrangement and thereafter relocking the locking arrangement are performed between the step of using the elevator car for transporting passengers and/or goods, and the step of subsequently using the elevator car for transporting passengers and/or goods.

* * * * *